US010690094B2

(12) United States Patent
Ito et al.

(10) Patent No.: US 10,690,094 B2
(45) Date of Patent: Jun. 23, 2020

(54) INTAKE APPARATUS

(71) Applicant: AISAN KOGYO KABUSHIKI KAISHA, Obu-shi, Aichi-ken (JP)

(72) Inventors: Naruto Ito, Nisshin (JP); Mamoru Yoshioka, Nagoya (JP); Akinari Yasue, Tokai (JP); Hironori Suzuki, Obu (JP); Kaisho So, Nagoya (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 9 days.

(21) Appl. No.: 16/035,966

(22) Filed: Jul. 16, 2018

(65) Prior Publication Data

US 2019/0063381 A1 Feb. 28, 2019

(30) Foreign Application Priority Data

Aug. 31, 2017 (JP) ..... 2017-166507

(51) Int. Cl.

| | |
|---|---|
| ***F01P 7/16*** | (2006.01) |
| ***F02M 35/10*** | (2006.01) |
| ***F02M 26/20*** | (2016.01) |
| ***F02M 35/104*** | (2006.01) |

(Continued)

(52) U.S. Cl.

CPC ..... *F02M 35/10222* (2013.01); *F02M 26/20* (2016.02); *F02M 26/28* (2016.02); *F02M 35/104* (2013.01); *F02M 35/10052* (2013.01); *F02M 35/10144* (2013.01); *F02M 35/10268* (2013.01); *F02M 26/06* (2016.02)

(58) Field of Classification Search

CPC ..... F02B 29/0406; F02M 35/10222; F02M 35/10052; F02M 35/10144; F02M 35/104; F02M 26/20; F02M 26/06; F02M 26/28; F02M 26/33; F02M 26/35; F02M 26/30; F01P 7/16; Y02T 10/146

USPC ..... 123/568.12, 568.17, 568.18; 60/320; 701/108

See application file for complete search history.

(56) References Cited

U.S. PATENT DOCUMENTS 6,152,118 A * 11/2000 Sasaki ..... F02D 21/08 123/568.21
10,260,461 B2 * 4/2019 Minami ..... F02M 26/06

(Continued)

FOREIGN PATENT DOCUMENTS

JP 2005-155448 A 6/2005
JP 2018-105180 A 7/2018

*Primary Examiner* — Hai H Huynh
*Assistant Examiner* — Gonzalo Laguarda
(74) *Attorney, Agent, or Firm* — Oliff PLC

(57) ABSTRACT

An intake apparatus includes an intake manifold, an EGR gas distributor, and an EGR cooler. The intake manifold includes a surge tank and branch pipes. The EGR gas distributor includes a gas inlet, a gas chamber, and gas distribution pipes connected to the branch pipes. The branch pipes are each formed with a connecting hole for the gas distribution pipes. The EGR cooler is provided adjacent to the gas chamber to warm the inside wall of the gas chamber and includes a hot water passage and a gas passage. The gas chamber and the hot water passage are arranged to traverse the branch pipes. The gas distribution pipes are connected to the corresponding connecting holes. The EGR gas distributor and the EGR cooler in an integrated form are attached to the intake manifold.

5 Claims, 15 Drawing Sheets

(51) Int. Cl.
*F02M 26/28* (2016.01)
*F02M 26/06* (2016.01)

(56) References Cited

U.S. PATENT DOCUMENTS

2018/0100471 A1* 4/2018 Minami ..... F02M 26/06
2018/0179999 A1 6/2018 Yoshioka et al.

* cited by examiner

INTAKE APPARATUS

CROSS-REFERENCE TO RELATED APPLICATIONS

This application is based upon and claims the benefit of priority from the prior Japanese Patent Application No. 2017-166507 filed on Aug. 31, 2017, the entire contents of which are incorporated herein by reference.

BACKGROUND

Technical Field

The present disclosure relates to an intake apparatus provided with: an intake manifold including a plurality of branch pipes; and a gas distributor for distributing auxiliary gas, such as EGR gas and PCV gas, to each of the branch pipes.

Related Art

As the above type of techniques, for example, there has been known an intake manifold disclosed in Japanese unexamined patent application publication No. 2005-155448 (JP 2005-155448A). This intake manifold is provided with a plurality of intake pipes (branch pipes) each configured to distribute intake air to one of cylinders and an EGR gas chamber (a gas distributor) configured to distribute EGR gas to each of the intake pipes. The EGR gas chamber is provided on an upper side of the intake pipes and in an orientation traversing and straddling each intake pipe. The EGR gas chamber is formed integrally with the intake manifold. Further, the EGR gas chamber is constituted of a chamber body formed integrally with an upper wall of the intake manifold and a cover body that covers an opening formed on an upper surface side of the chamber body. The chamber body is also formed, in its bottom wall, with an EGR gas inflow port. The intake manifold is formed with an EGR gas passage communicated with the EGR gas inflow port. The chamber body is further formed with communication holes each communicated with one of the intake pipes. The cover body is formed, in its inside, with a recess for allowing EGR gas to stay therein. On the outside of the recess, a hot water passage is provided adjacent to the recess to allow engine cooling water (hot water) to flow. Accordingly, part of the EGR gas having flowed in the EGR gas chamber through the EGR gas inflow port can stay in the recess. This greatly promotes a heat exchange action between the EGR gas staying in the recess and the hot water flowing through the hot water passage, so that the EGR gas in the entire EGR gas chamber can be efficiently kept warm and the occurrence of condensed water in that EGR gas chamber and the freezing of such a condensed water can be suppressed.

SUMMARY

Technical Problem

Meanwhile, in JP 2005-155448A, it is conceived that the above intake manifold is made as a rein molded component even though not specified. Herein, since the EGR gas chamber is constituted of: the chamber body formed integrally with the intake manifold; and the cover body covering the chamber body, the chamber body is assumed to be made of resin by molding integrally with the intake manifold.

However, the rein molded component has a limitation in shape in terms of a demolding work. Thus, while keeping a hollow shape of each of the EGR gas passage and the plurality of intake pipes, it is difficult to form each communication hole in a direction intersecting the passage direction. Such an EGR gas chamber formed integrally with the intake manifold could lack general versatility for different types of intake manifolds.

In the above EGR gas chamber, in contrast, keeping the EGR gas warm can suppress the generation of condensed water, but it is conceivable that a little condensed water may be generated. However, each communication hole provided in the chamber body simply communicates with each corresponding intake pipe and thus a leakage flow of the condensed water from each communication hole to each intake pipe may flow down to an upstream side of each intake pipe depending on the placement of the communication holes. Since a surge tank is usually provided on the upstream side of the intake pipes, the condensed water may be accumulated in the surge tank.

This disclosure has been made to address the above problems and has a purpose to provide an intake apparatus provided with a gas distributor for distributing auxiliary gas, such as EGR gas, to each branch pipe of an intake manifold and configured to suppress the generation of condensed water in the gas distributor and further realize the general versatility of the gas distributor to different types of intake manifolds.

Means of Solving the Problem

To achieve the above-mentioned purpose, one aspect of the present disclosure provides an intake apparatus comprising: an intake manifold including a surge tank and a plurality of branch pipes each branching off from the surge tank; a gas distributor provided separately from the intake manifold and configured to distribute auxiliary gas to each of the plurality of branch pipes, the gas distributor including a gas inlet configured to introduce the auxiliary gas, a gas chamber configured to collect the auxiliary gas introduced through the gas inlet, and a plurality of gas distribution pipes each branching off from the gas chamber and each configured to connect to one of the branch pipes; a plurality of connecting holes each provided in one of the branch pipes and each configured to connect to a corresponding one of the gas distribution pipes; and a hot water passage provided separately from the intake manifold and placed adjacently to the gas chamber to warm an inside wall of the gas chamber, the hot water passage being configured to flow hot water, wherein the gas chamber and the hot water passage are arranged to traverse the plurality of branch pipes, the gas distribution pipes are each connected to one of the connecting holes, and at least one of the gas distributor and the hot water passage is attached to the intake manifold.

According to the present disclosure, an inside wall of a gas chamber of a gas distributor can be efficiently warmed with hot water in the gas chamber, thus enabling prevention of generation and freezing of condensed water on the inside wall of the gas chamber. Furthermore, standardization of the gas distributor and a hot water passage can lead to general versatility for different types of intake manifolds.

DETAILED DESCRIPTION OF THE EXEMPLARY EMBODIMENTS

A detailed description of an embodiment of an intake apparatus which is one of typical embodiments of this disclosure will now be given referring to the accompanying drawings.

<Intake Apparatus>

Figure 1:
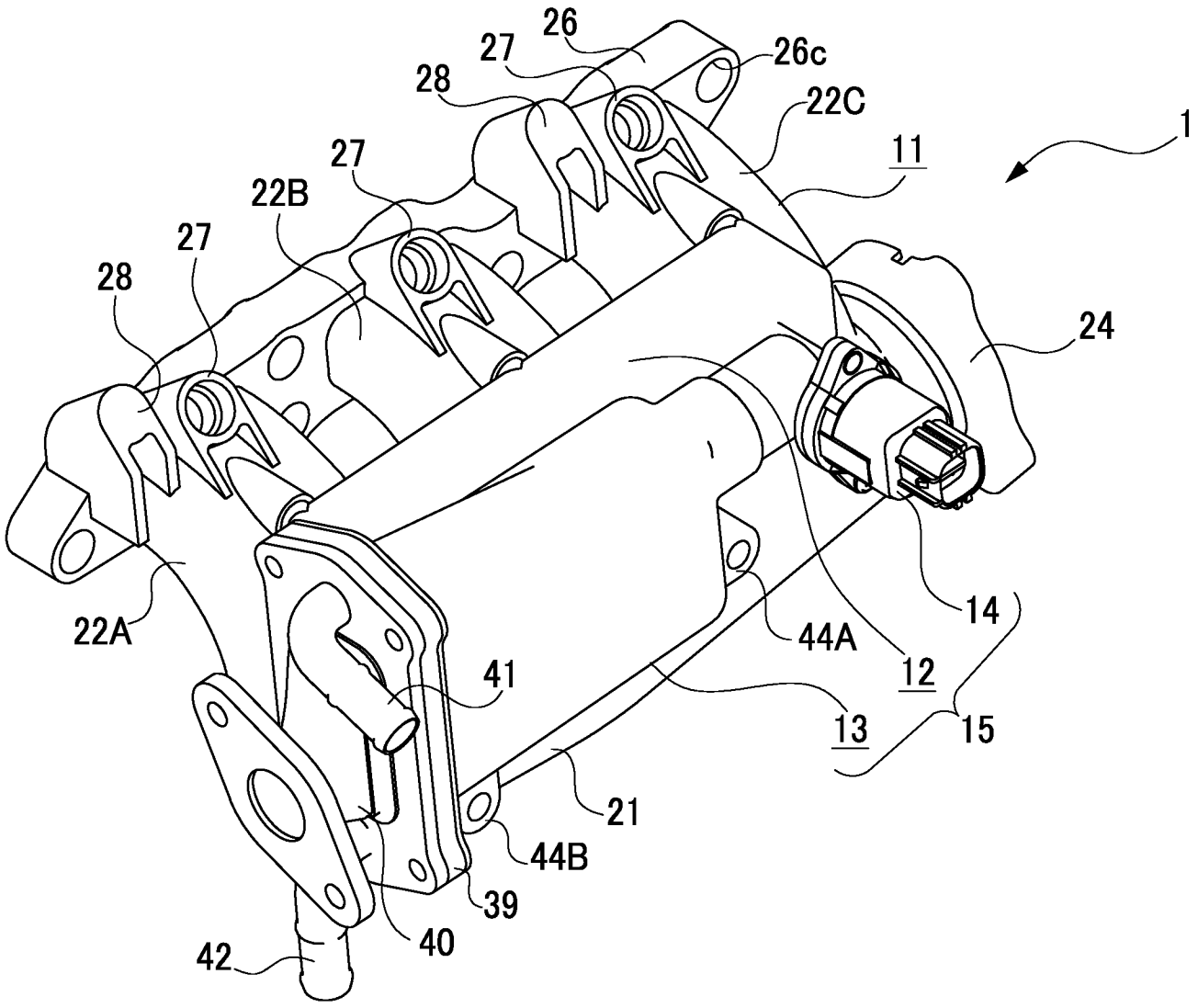
FIG. 1 is a perspective view of an intake apparatus viewed from a front side in an embodiment.
Figure 2:
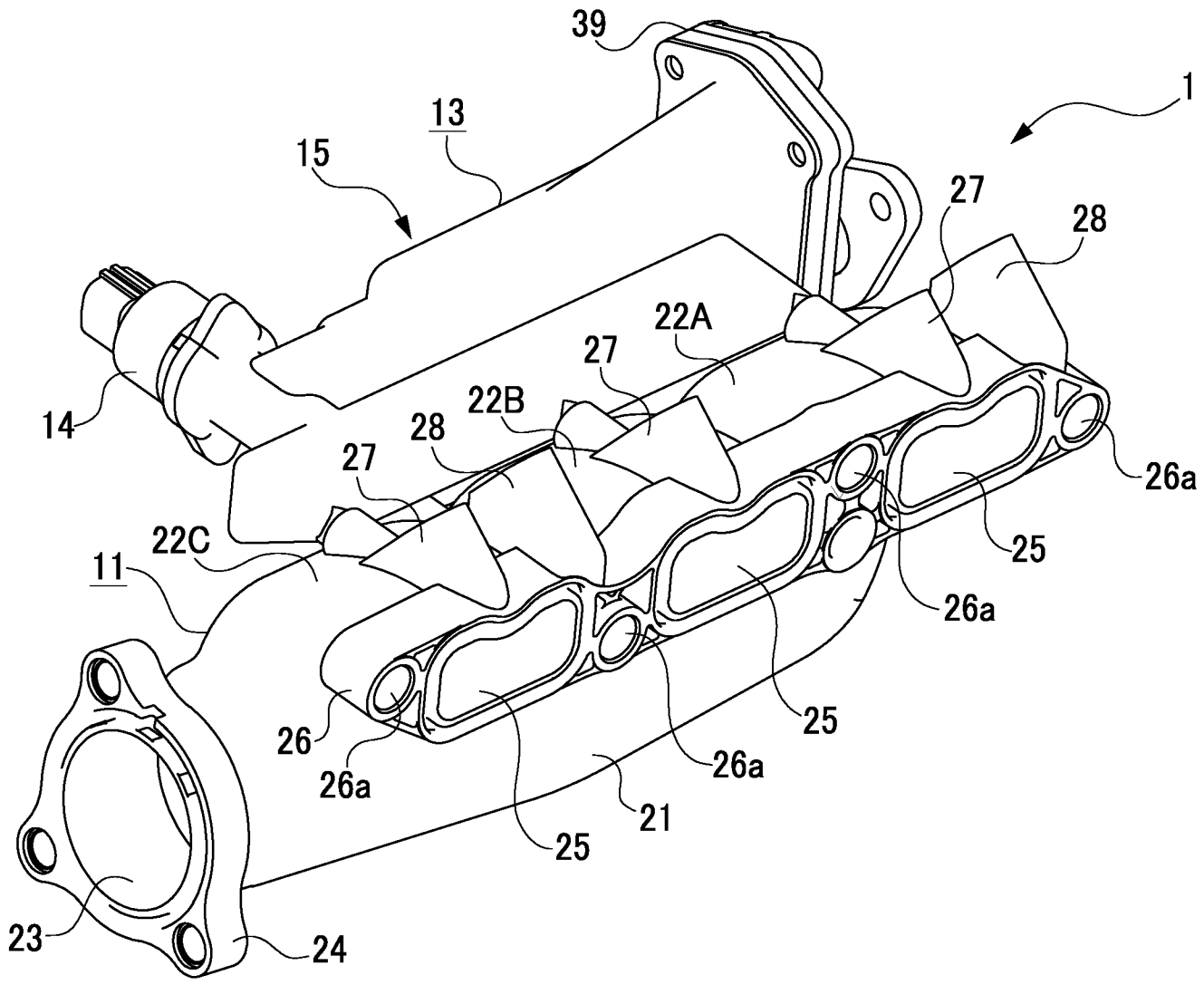
FIG. 2 is a perspective view of the intake apparatus viewed from a back side in the embodiment.
Figure 3:
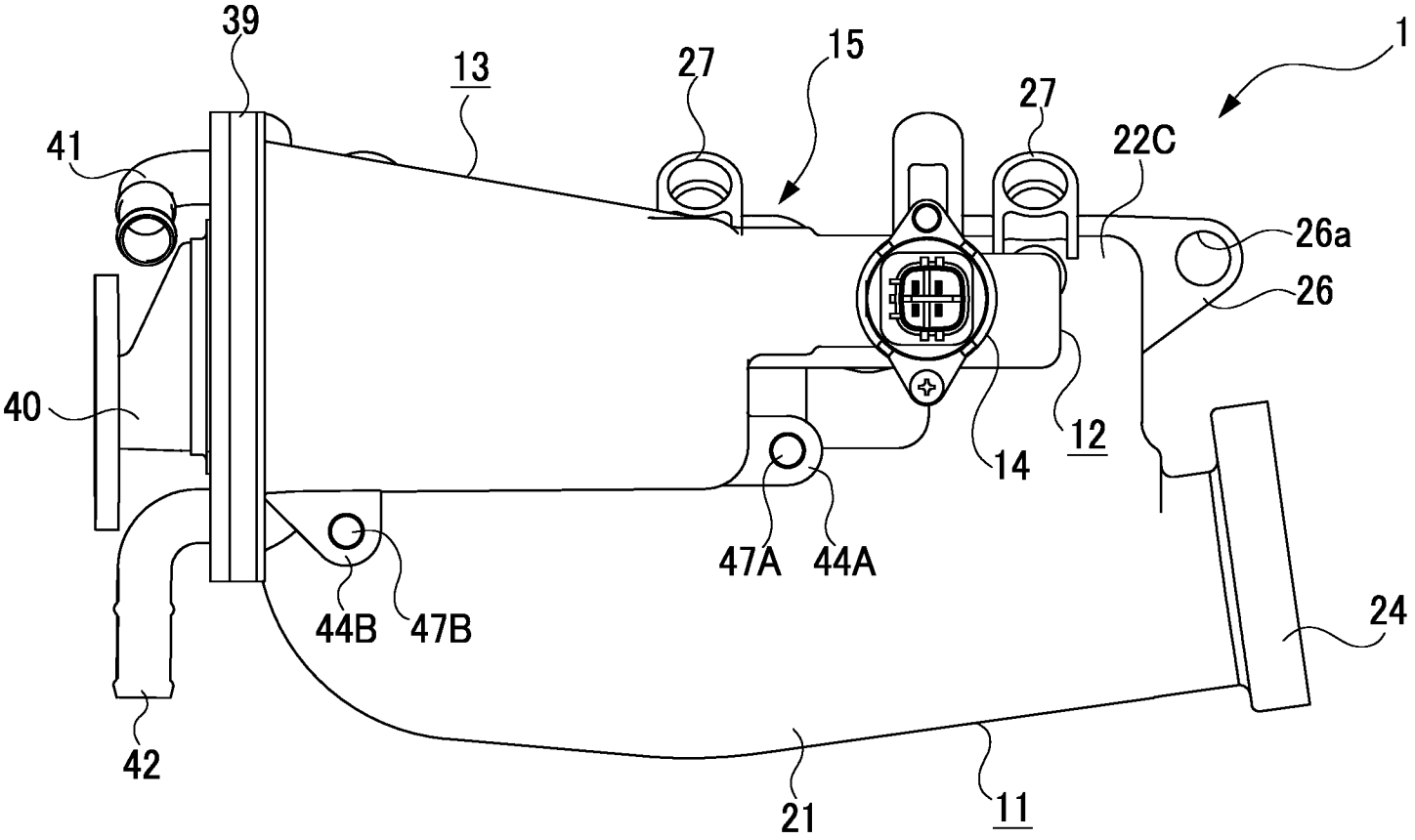
FIG. 3 is a front view of the intake apparatus in the embodiment.
Figure 4:
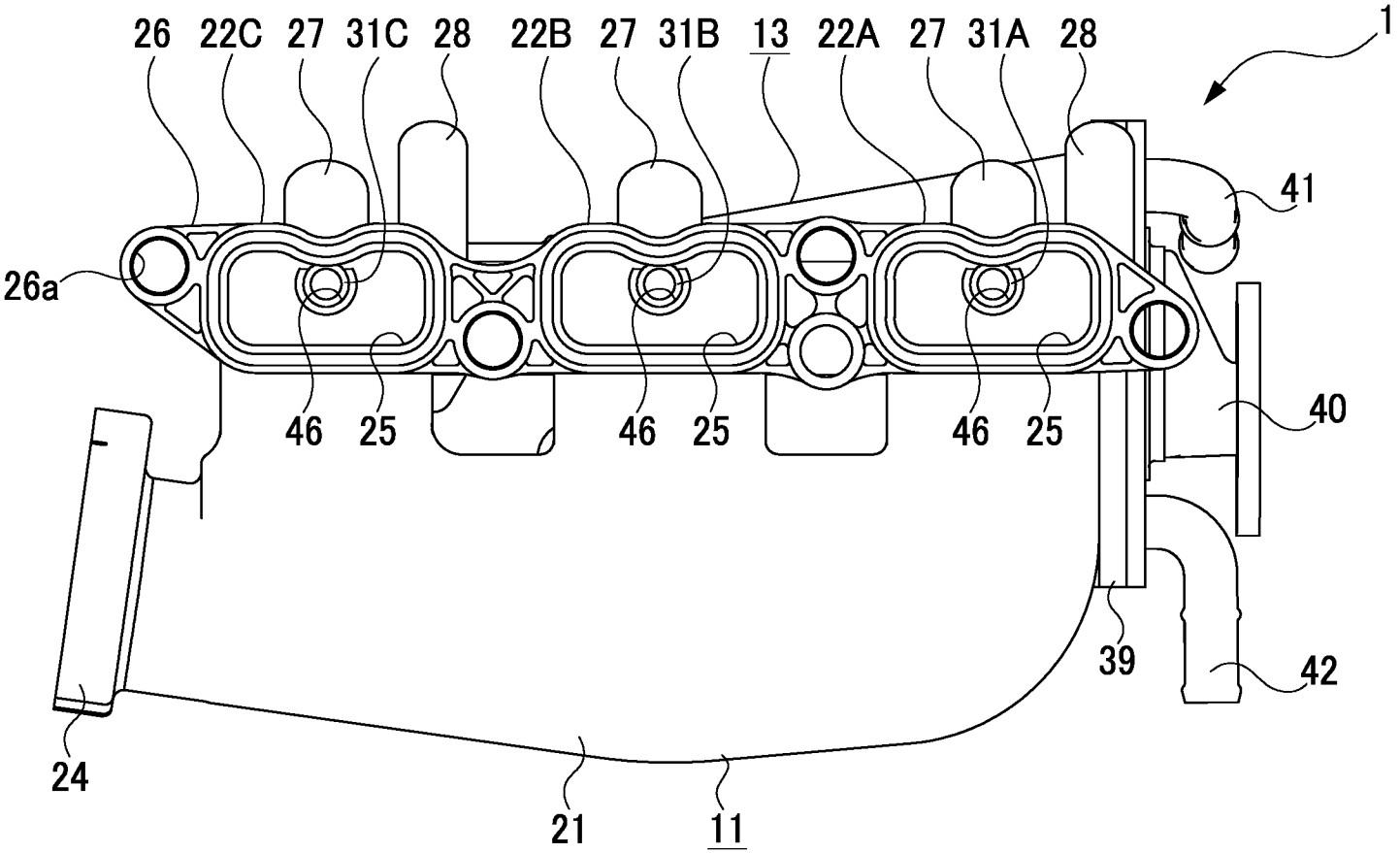
FIG. 4 is a back view of the intake apparatus in the embodiment.
Figure 5:
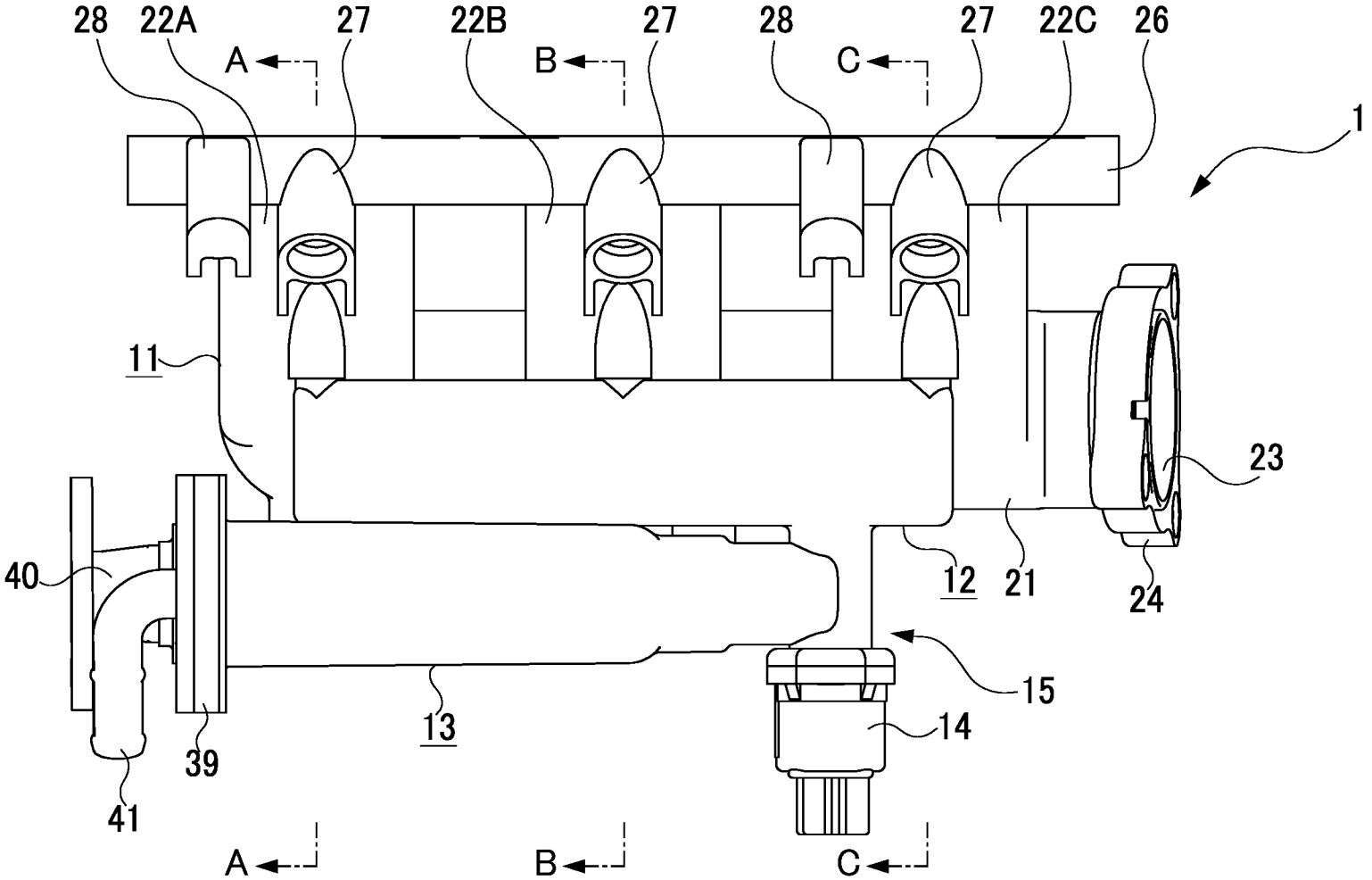
FIG. 5 is a plane view of the intake apparatus in the embodiment.
Figure 6:
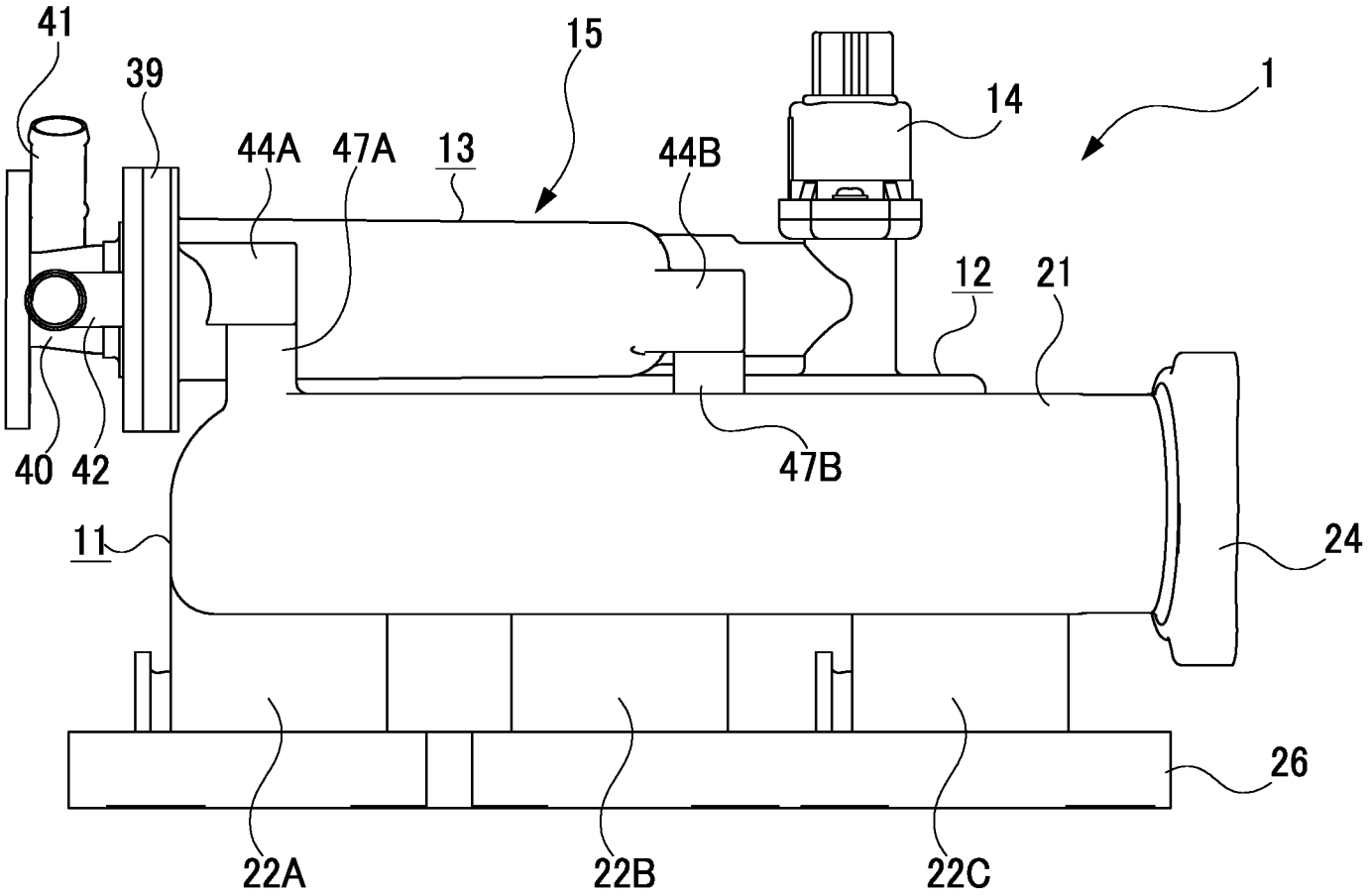
FIG. 6 is a bottom view of the intake apparatus in the embodiment.
Figure 7:
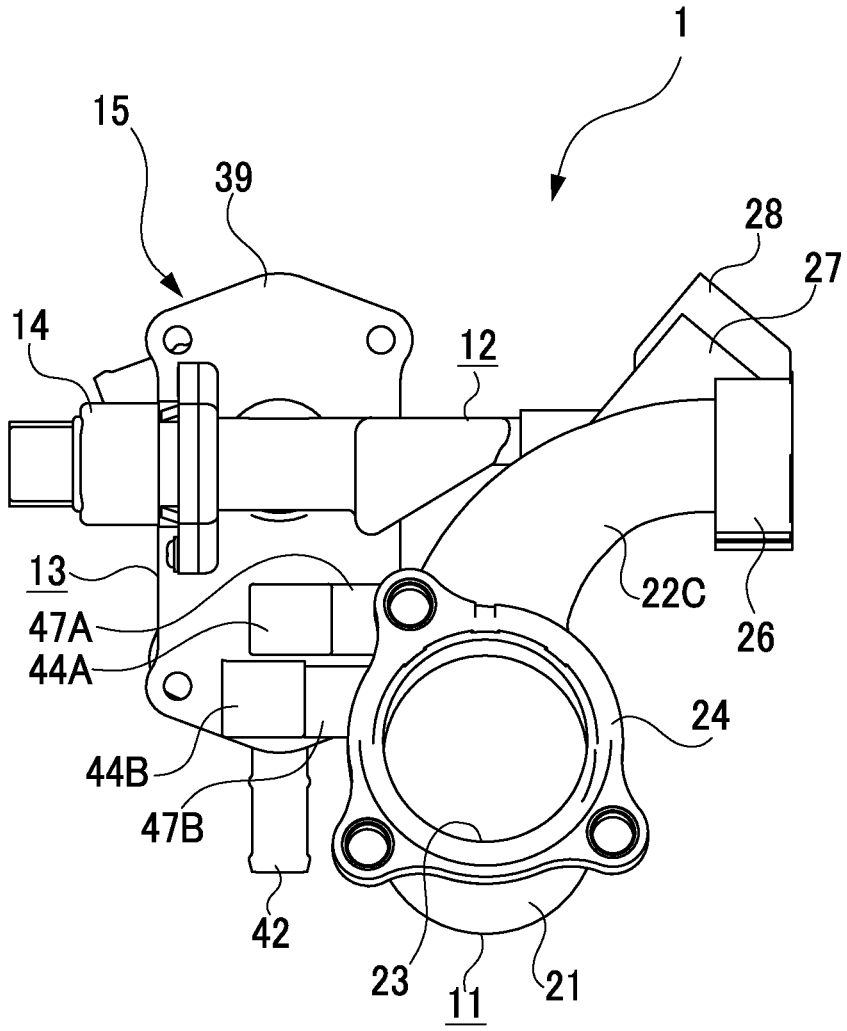
FIG. 7 is a right-side view of the intake apparatus in the embodiment.
Figure 8:
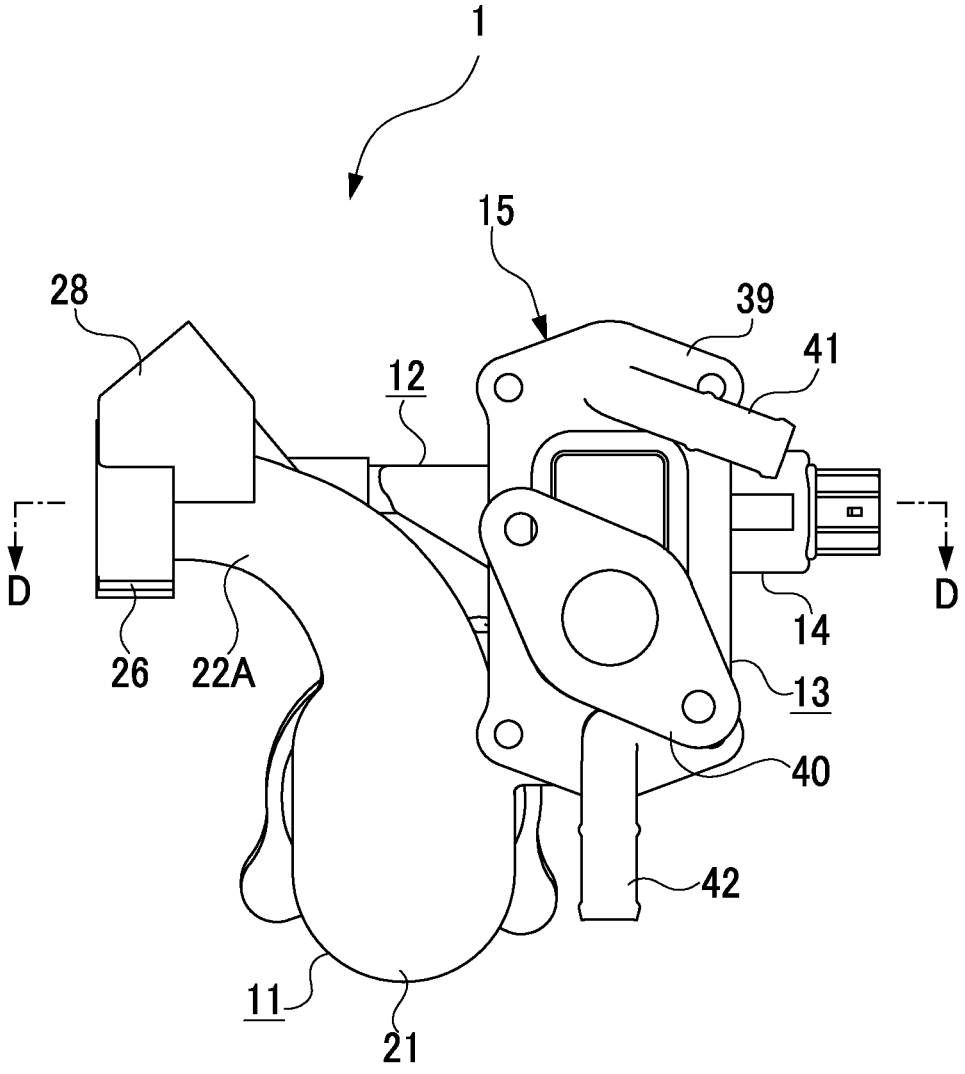
FIG. 8 is a left-side view of the intake apparatus in the embodiment.
Figure 9:
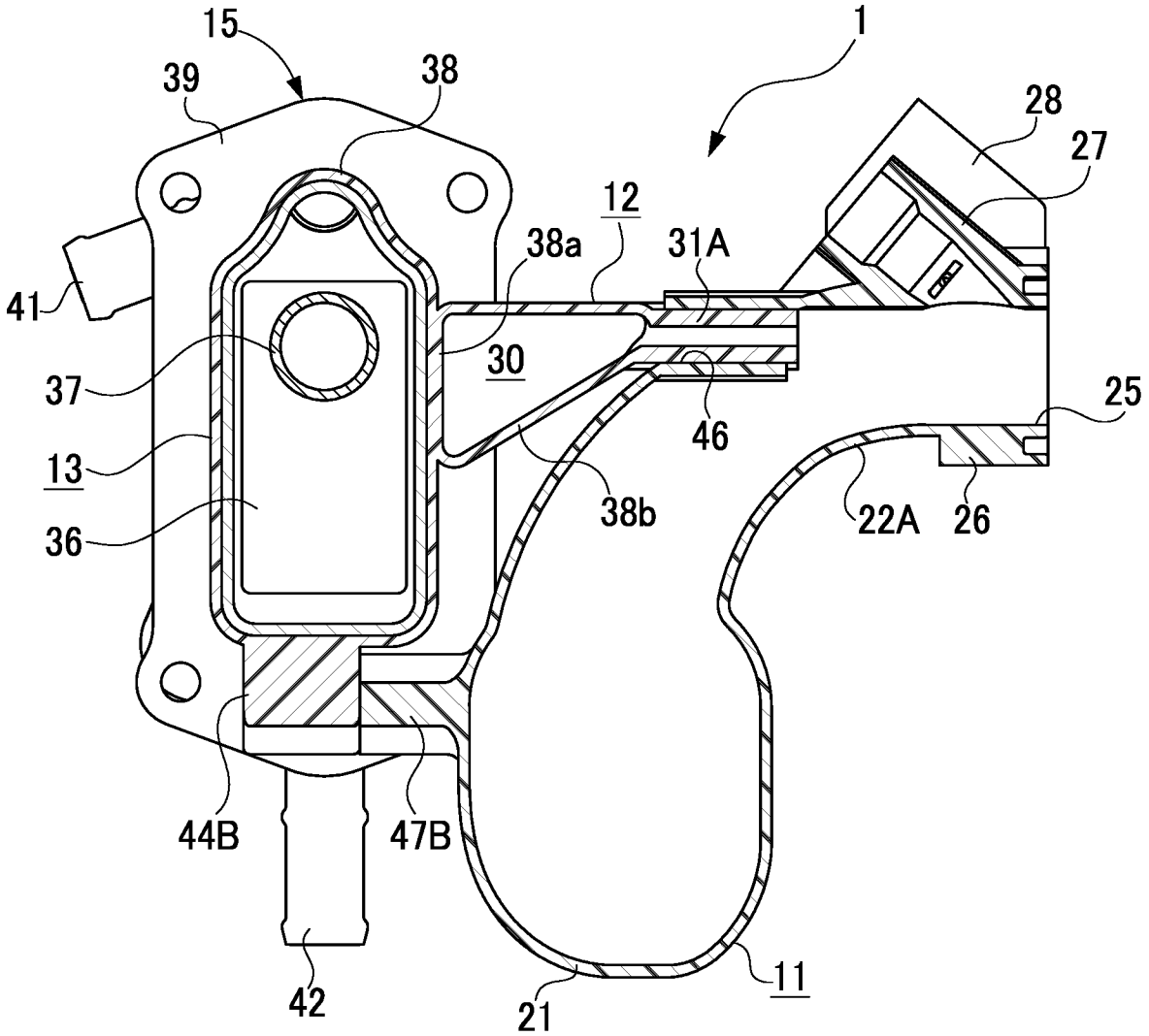
FIG. 9 is a cross-sectional view of the intake apparatus taken along a line A-A in FIG. 5 in the embodiment.
Figure 10:
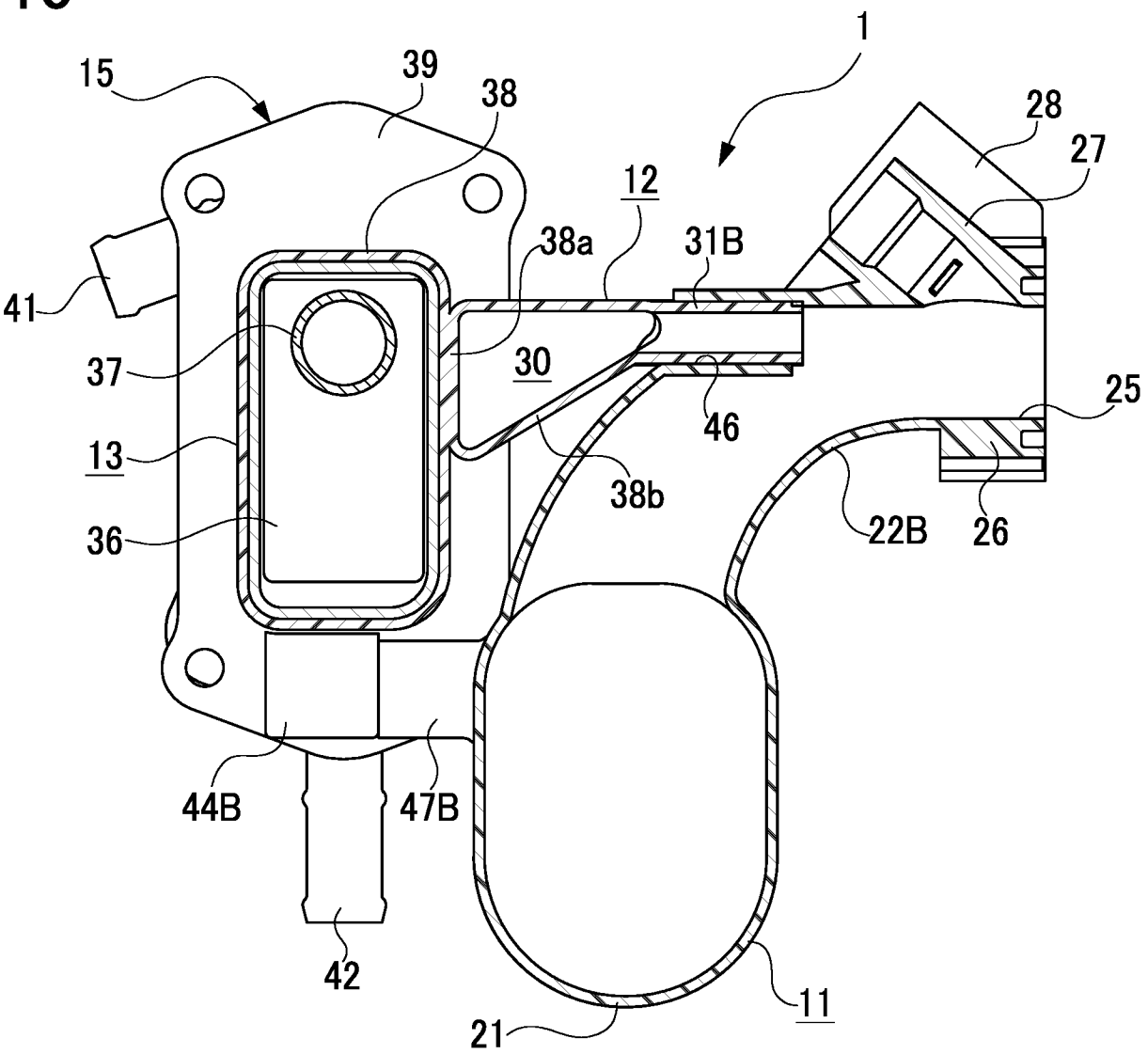
FIG. 10 is a cross-sectional view of the intake apparatus taken along a line B-B in FIG. 5 in the embodiment.
Figure 11:
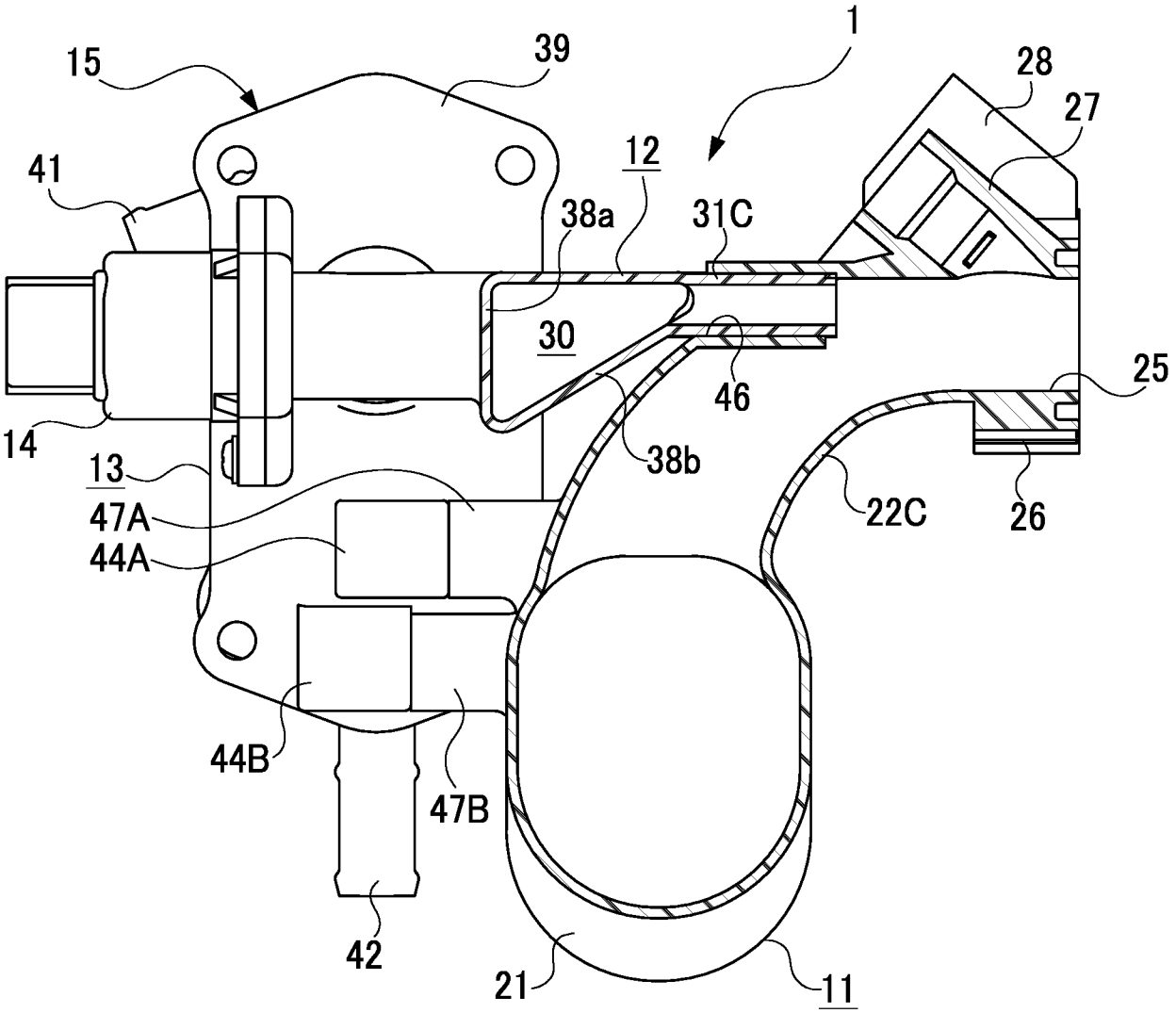
FIG. 11 is a cross-sectional view of the intake apparatus taken along a line C-C in FIG. 5 in the embodiment.
Figure 12:
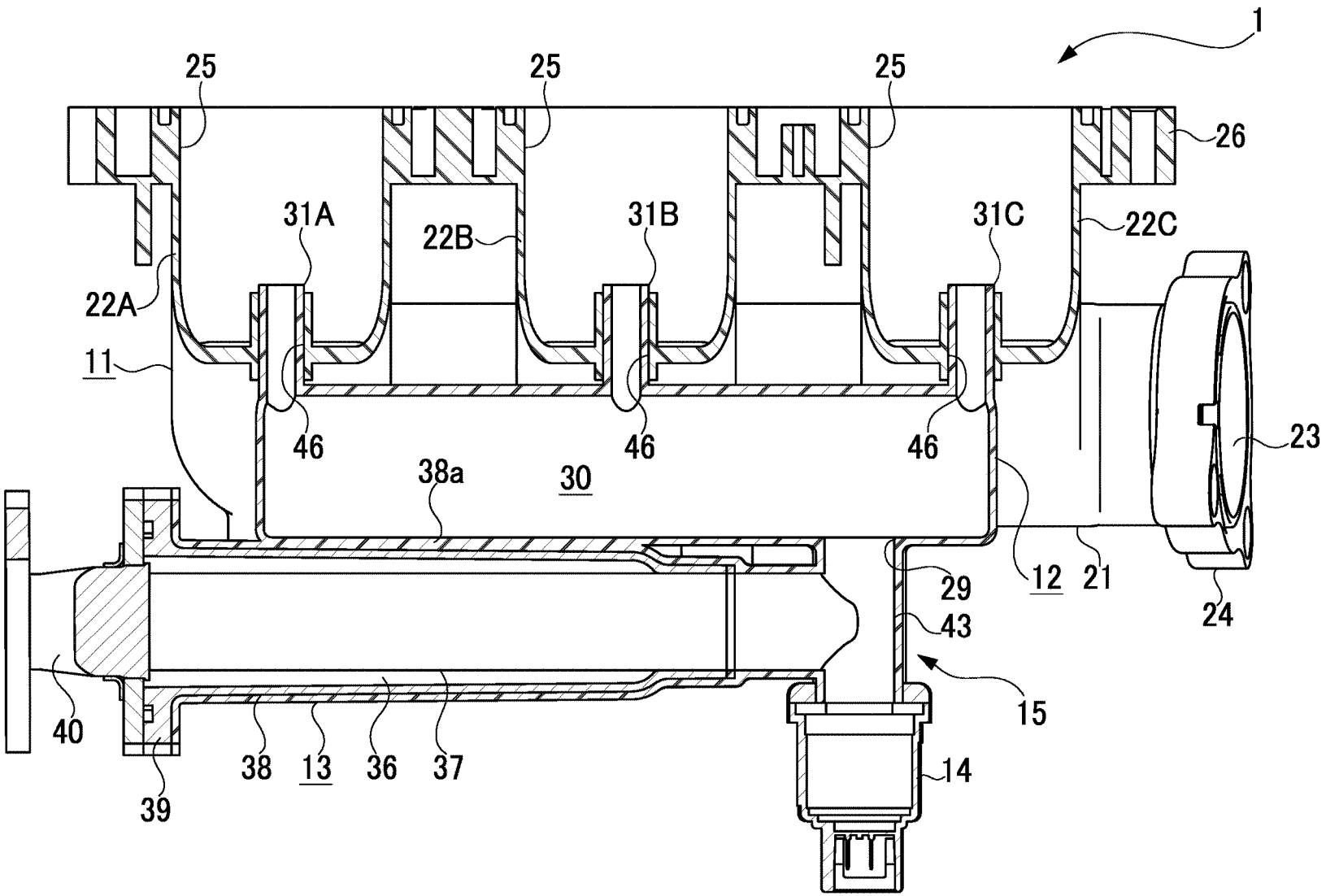
FIG. 12 is a cross-sectional view of the intake apparatus taken along a line D-D in FIG. 8 in the embodiment.
Figure 13:
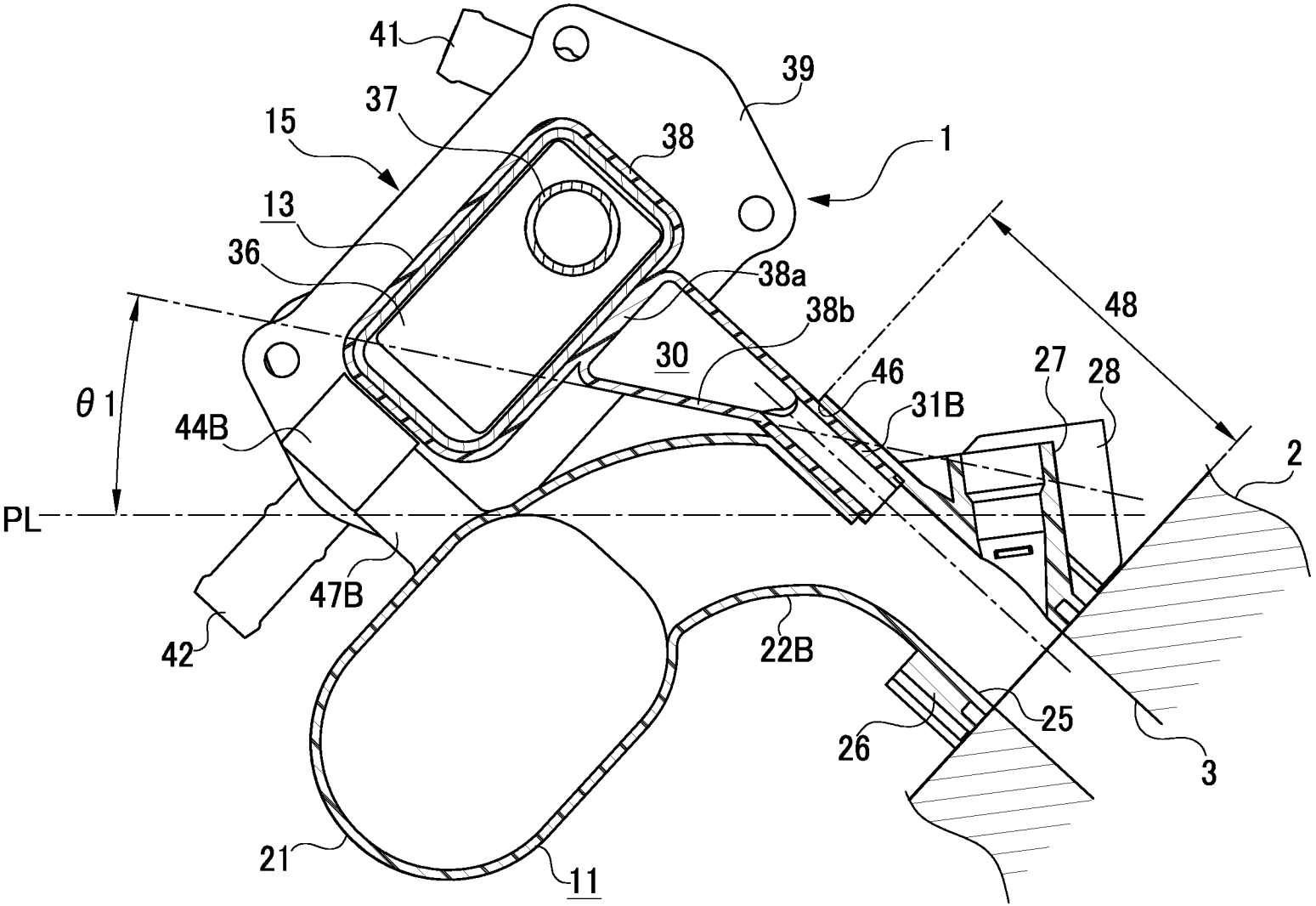
FIG. 13 is a cross-sectional view of the intake apparatus attached to an engine mounted in a proper position in the embodiment.

FIG. 1 is a perspective view of an intake apparatus 1 viewed from a front side. FIG. 2 is a perspective view of the intake apparatus 1 viewed from a back side. FIG. 3 is a front view of the intake apparatus 1. FIG. 4 is a back view of the intake apparatus 1. FIG. 5 is a plane view of the intake apparatus 1. FIG. 6 is a bottom view of the intake apparatus 1. FIG. 7 is a right-side view of the intake apparatus 1. FIG. 8 is a left-side view of the intake apparatus 1. FIG. 9 is a cross-sectional view of the intake apparatus 1 taken along a line A-A in FIG. 5. FIG. 10 is a cross-sectional view of the intake apparatus 1 taken along a line B-B in FIG. 5. FIG. 11 is a cross-sectional view of the intake apparatus 1 taken along a line C-C in FIG. 5. FIG. 12 is a cross-sectional view of the intake apparatus 1 taken along a line D-D in FIG. 8. FIG. 13 is a cross-sectional view of the intake apparatus 1 attached to an engine 2 mounted in a proper position.

The upper and lower sides and right and left sides of the intake apparatus 1 are specified as shown in FIGS. 3 and 4 or FIGS. 7 and 8. A state of the intake apparatus 1 actually attached to the engine 2 is as illustrated in FIG. 13. This intake apparatus 1 is used in the attached state to the engine 2 to introduce intake air and EGR gas as auxiliary gas to a plurality of cylinders of the engine 2. The intake apparatus 1 is provided with an intake manifold 11 and an EGR unit 15. This EGR unit 15 includes an EGR gas distributor 12, an EGR cooler 13, and an EGR valve 14. The EGR gas distributor 12 corresponds to one example of a gas distributor in the present disclosure. The EGR cooler 13 corresponds to one example of an auxiliary gas cooler in the present disclosure, in which a hot water passage (also serving as a cooling water passage) 36 (see FIG. 12 and others and a gas passage 37 (see FIGS. 12 and others) are internally contained. The EGR valve 14 is configured to be electrically controlled to regulate a flow rate of EGR gas allowed to flow from the EGR cooler 13 into the EGR gas distributor 12.

<Intake Manifold>

In the present embodiment, the intake manifold 11 includes a surge tank 21 and a plurality of branch pipes 22A, 22B, and 22C each branching off from the surge tank 21. The branch pipes 22A to 22C are formed to curve in parallel to each other from the surge tank 21 and extend in the same direction. In the present embodiment, the intake manifold 11 includes three branch pipes 22A to 22C for a 3-cylinder engine 2. The surge tank 21 is formed with an intake inlet 23 to introduce intake air into the surge tank 21. An inlet flange 24 surrounds the outer circumference of the intake inlet 23. The inlet flange 24 is adapted to allow attachment of a well-known throttle device. At a downstream end of each of the branch pipes 22A to 22C, an intake outlet 25 is provided to introduce intake air toward each intake port 3 (see FIG. 13) of the engine 2. An outlet flange 26 surrounds the outer circumference of each intake outlet 25. This outlet flange 26 is formed with a plurality of bolt holes 26*a* to receive bolts or the like for attachment of the intake manifold 11 to the engine 2. In addition, in the branch pipes 22A to 22C near respective intake outlets 25, there are correspondingly provided three attachment parts 27 for installing injectors for fuel injection and attachment parts 28 for fixing a fuel distributor that supports the injectors.

<EGR Gas Distributor>

In the present embodiment, the EGR gas distributor 12 is made of a resin material as a separate component from the intake manifold 11 and is retrofitted to the intake manifold 11. In the present embodiment, for the purpose of enhancing the heat transfer of the EGR gas distributor 12, this distributor 12 is made of a resin material containing carbon. The EGR gas distributor 12 serves to distribute EGR gas to each of the branch pipes 22A to 22C. As shown in FIG. 12 and others, the EGR gas distributor 12 includes a gas inlet 29 configured to introduce EGR gas, a gas chamber 30 configured to collect the EGR gas introduced therein through the gas inlet 29, and a plurality of gas distribution pipes 31A, 31B, and 31C each branching off from the gas chamber 30 and configured to respectively communicate with the branch pipes 22A, 22B, and 22C.

<EGR Cooler>

In the present embodiment, the EGR cooler 13 internally contains the hot water passage 36 and the gas passage 37 and is formed integrally with the EGR gas distributor 12. Specifically, the EGR cooler 13 is formed integrally with the EGR gas distributor 12 but is formed separately from the intake manifold 11. The EGR cooler 13 is provided adjacently to and integrally with the EGR gas distributor 12 to warm the inside wall of this distributor 12. The EGR cooler 13 is provided with a casing 38 made of a resin material in an integral form with the EGR gas distributor 12. Within this casing 38, there are placed the hot water passage 36 to flow engine cooling water (hot water) and the gas passage 37 to flow EGR gas. A cooler flange 39 is provided at one end of the EGR cooler 13. This cooler flange 39 is provided with a gas introduction part 40 configured to introduce EGR gas, a water inflow pipe joint 41 configured to introduce engine cooling water, and a water outflow pipe joint 42 configured to discharge out the engine cooling water. Further, at the other end of the EGR cooler 13, a communication passage 43 is provided to connect the gas passage 37 to the gas inlet 29 of the EGR gas distributor 12. The EGR valve 14 is placed in this communication passage 43. The EGR cooler 13 further includes two brackets 44A and 44B configured to attach the EGR unit 15 to the intake manifold 1.

<Structure For Attaching EGR Unit>

Next, a structure for attaching the EGR unit 15 to the intake manifold 11 will be described below. The branch pipes 22A to 22C of the intake manifold 11 are each provided with a connecting hole 46 configured to connect to a corresponding one of gas distribution pipes 31A to 31C of the EGR gas distributor 12. The connecting holes 46 are open near and toward the corresponding intake outlets 25. The intake manifold 11 includes two connecting rods 47A and 47B protruded and connected respectively to the brackets 44A and 44B of the EGR cooler 13. In the present embodiment, the EGR gas distributor 12 and the EGR cooler 13 are placed in parallel to each other in a longitudinal direction. Thus, the gas chamber 30 of the EGR gas distributor 12 and the hot water passage 36 of the EGR cooler 13 are arranged adjacent to each other through a partition wall 38*a* in the longitudinal direction. As shown in FIGS. 7 to 11, the gas chamber 30 of the EGR gas distributor 12 has a cross section of a nearly triangular shape so that a portion of the gas chamber 30 defined by one side of the triangular shape is formed by the partition wall 38*a* extending in the longitudinal direction.

Herein, the gas chamber 30 of the EGR gas distributor 12 and the hot water passage 36 of the EGR cooler 13 are arranged in an orientation extending in the longitudinal direction so as to traverse the plurality of branch pipes 22A to 22C. The gas distribution pipes 31A to 31C are each connected to the corresponding connecting holes 46. The two brackets 44A and 44B of the EGR cooler 13 are connected respectively to the two connecting rods 47A and 47B of the intake manifold 11. In this manner, the EGR unit 15 is attached to the intake manifold 11.

As shown in FIG. 13, the intake manifold 11 is installed in an orientation inclined downward at a predetermined angle θ1 with respect to a horizontal direction PL onto the engine 2 mounted in a proper position (i.e., an actually installed position of the engine 2 in a vehicle). When the intake manifold 11 is attached to the engine 2 mounted in the proper position, a pipe section 48 defined by a part of each of the branch pipes 22A to 22C, in which the connecting holes 46 and the intake outlets 25 are provided, is placed to be directed, or inclined, downward relative to the horizontal direction PL. Accordingly, outlets of the gas distribution pipes 31A to 31C connected to the connecting holes 46 are also directed toward the corresponding intake outlets 25 and downward relative to the horizontal direction PL. In addition, as shown in FIGS. 9-11 and 13, the gas chamber 30 of the EGR gas distributor 12 includes a bottom wall 38*b* in an orientation extending in the longitudinal direction so as to traverse the plurality of branch pipes 22A to 22C. When the EGR unit 15 is attached to the intake manifold 11 and further the intake manifold 11 is attached to the engine 2, the bottom wall 38*b* is directed, or inclined, downward relative to the horizontal direction PL as shown in FIG. 13. Thus, the bottom wall 38*b* and the gas distribution pipes 31A to 31C are each inclined downward relative to the horizontal direction PL.

<Method For Attaching Intake Apparatus To Engine>

Herein, the intake manifold 11 is first installed onto the engine 2 before the intake apparatus 1 is attached to the engine 2. Specifically, the outlet flange 26 of the intake manifold 11 is secured with bolts tightened to the engine 2 in a position corresponding to the plurality of intake ports 3 of the engine 2. At that time, the EGR unit 15 does not exist near the outlet flange 26 and therefore the EGR unit 15 itself does not interfere with a work of tightening the bolts. Successively, the EGR unit 15 is attached to the intake manifold 11. This attaching procedure is conducted as follows. Firstly, the gas distribution pipes 31A to 31C of the EGR gas distributor 12 are connected by press-fitting into the corresponding connecting holes 46. Secondly, the two brackets 44A and 44B are connected respectively to the connecting rods 47A and 47B. This connecting method may be performed by bonding or welding the brackets 44A and 44B to the connecting rods 47A and 47B or by securing them with bolts or the like.

According to the configuration of the intake apparatus 1 in the present embodiment described as above, the hot water passage 36 is provided adjacently to the gas chamber 30 of the EGR gas distributor 12, so that the heat of hot water flowing through the hot water passage 36 transfers to the inside wall of the gas chamber 30, thereby warming this inside wall. Accordingly, the inside wall of the gas chamber 30 of the EGR gas distributor 12 can be efficiently warmed by the hot water, thus enabling preventing condensed water from being generated and frozen on the inside wall of the gas chamber 30.

According to the configuration in the present embodiment, the gas chamber 30 and the hot water passage 36 are placed so as to traverse or extend across the plurality of branch pipes 22A to 22C, the gas distribution pipes 31A to 31C are connected to the corresponding connecting holes 46, and also the EGR gas distributor 12 and the EGR cooler 13 are attached to the intake manifold 11. Therefore, when the EGR unit 15 provided with the EGR gas distributor 12 and the EGR cooler 13 is standardized, this EGR unit 15 can also be used in any other type intake manifold. Thus, by standardizing the EGR gas distributor 12 and the EGR cooler 13 (including the hot water passage 36), general versatility for different types of intake manifolds can be achieved.

According to the configuration in the present embodiment, furthermore, the partition wall 38*a* interposed between the gas chamber 30 and the hot water passage 36 is made of a resin material containing carbon. This configuration exhibits high heat transfer, so that the heat of the hot water can be easily transferred to the inside wall of the gas chamber 30. In the EGR gas distributor 12, therefore, the inside wall of the gas chamber 30 can be more efficiently warmed by the hot water.

According to the configuration in the present embodiment, a portion of the gas chamber 30 having a nearly triangular cross-sectional shape, the portion corresponding to one side of the triangular shape, forms a rectangular partition wall 38*a* extending in the longitudinal direction. Thus, a heat transfer area between the gas chamber 30 and the hot water passage 36 is relatively large, resulting in an increase in quantity of heat to be transferred to the inside of the gas chamber 30. Also in this regard, in the EGR gas distributor 12, the inside wall of the gas chamber 30 can be more efficiently warmed by the hot water.

According to the configuration in the present embodiment, while the intake manifold 11 is attached to the engine 2 mounted in the proper position, the pipe section 48 defined by a part of each of the branch pipes 22A to 22C in which the connecting holes 46 and the intake outlets 25 are provided is placed to be directed, or inclined, downward relative to the horizontal direction PL. Thus, in the EGR gas distributor 12 attached to the intake manifold 11, the outlets of the gas distribution pipes 31A to 31C are also directed toward the intake port 3 of the engine 2 through the intake outlets 25. According to this configuration, if condensed water is unexpectedly generated in the gas chamber 30 and flows out through the gas distribution pipes 31A tot 31C, the condensed water is allowed to flow down into the intake port 3 of the engine 2 through each intake outlet 25. In other words, the condensed water flowing out from the gas distribution pipes 31A to 31C to the branch pipes 22A to 22C does not flow down into the surge tank 21. Accordingly, the intake apparatus 1 configured as above can suppress the generation of condensed water in the EGR gas distributor 12 and, even if the condensed water unexpectedly occurs and flows out of the EGR gas distributor 12, the intake apparatus 1 can also prevent such the condensed water from staying in the intake manifold 11. Herein, the unexpectedly generated condensed water is small in quantity; therefore, even if flowing into the engine 2, such a condensed water is less likely to lead to any defects, such as combustion deterioration.

According to the configuration in the present embodiment, while the intake apparatus 1 is in an attached state to the engine 2, the bottom wall 38*b* of the gas chamber 30 of the EGR gas distributor 12 is inclined downward toward the gas distribution pipes 31A to 31C. Thus, the condensed water unexpectedly generated in the gas chamber 30 is allowed to flow downward from the bottom wall 38*b* to the gas distribution pipes 31A to 31C. This configuration can prevent the condensed water generated in the EGR gas distributor 12 from staying in this distributor 12. Also in this case, a small quantity of condensed water unexpectedly generated may flow into the engine 2. However, even if flowing into the engine 2, such a small quantity of condensed water is less likely to any defects, such as combustion deterioration.

According to the configuration in the present embodiment, the hot water passage 36 is formed integrally with the EGR gas distributor 12, that is, the EGR cooler 13 including the hot water passage 36 is formed integrally with the EGR gas distributor 12. Standardization of those components thus enables attachment to the intake manifold 11. This can facilitate a work of attaching the EGR gas distributor 12 and the EGR cooler 13 (including the hot water passage 36) to the intake manifold 11.

According to the configuration in the present embodiment, the intake apparatus 1 is configured such that the intake manifold 11 is attached to the engine 2 and then the EGR unit 15 is retrofitted to the intake manifold 11. This configuration can prevent the existence of the EGR unit 15 from interfering with the work of attaching the intake manifold 11 to the engine 2.

The present disclosure is not limited to the foregoing embodiment and may be embodied in other specific forms without departing from the essential characteristics thereof.

Figure 14:
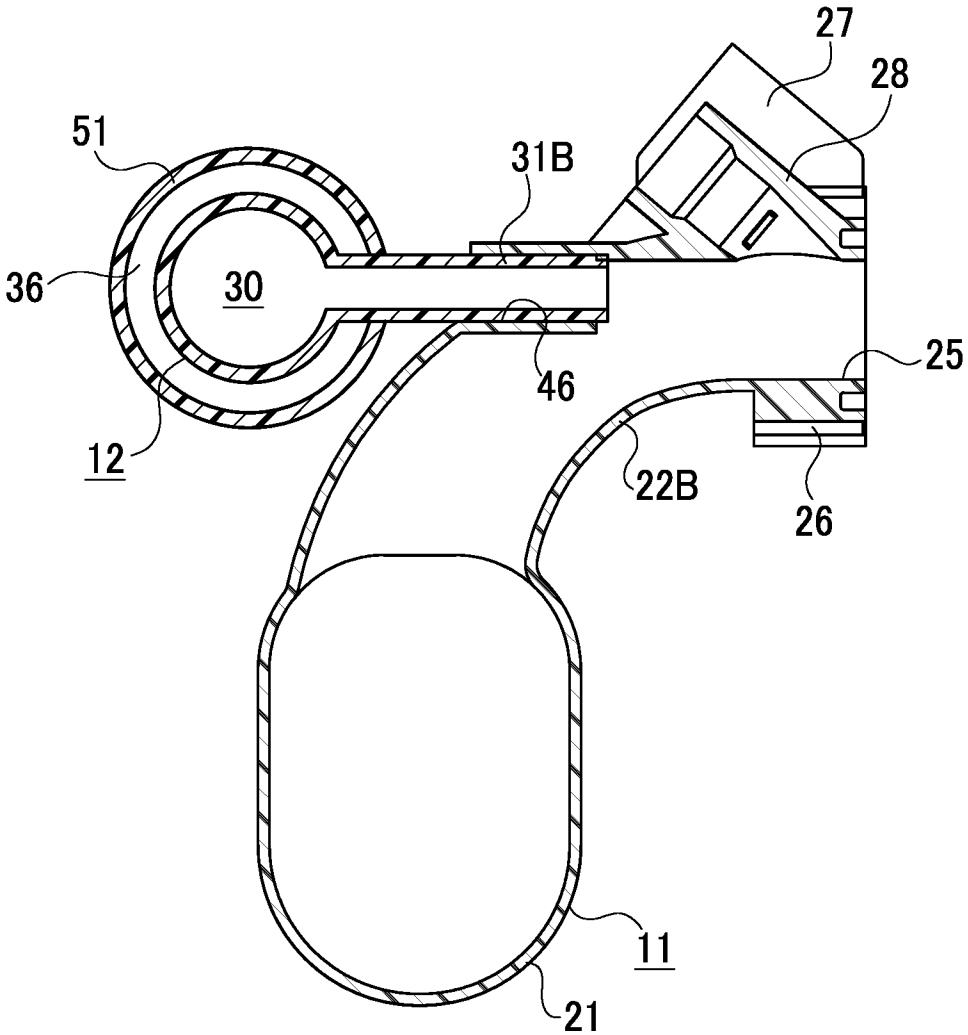
FIG. 14 is a cross-sectional view of an intake apparatus in another embodiment, corresponding to FIG. 10.

In the foregoing embodiment, the EGR cooler 13 internally containing the hot water passage 36 and the gas passage 37 is provided integrally with the EGR gas distributor 12. As an alternative, for example, an additional casing 51 may be provided to surround the gas chamber 30 of the EGR gas distributor 12 so that only the hot water passage 36 is provided integrally with the EGR gas distributor 12, as shown in FIG. 14. In this case, for example, a cooling water passage for supplying engine cooling water to an EGR cooler provided separately from the intake manifold 11 has only to be connected to this hot water passage 36. This configuration can also achieve the same operations and effects as in the foregoing embodiment. FIG. 14 shows this modified example of the intake apparatus in a cross-sectional view corresponding to FIG. 10.

Figure 15:
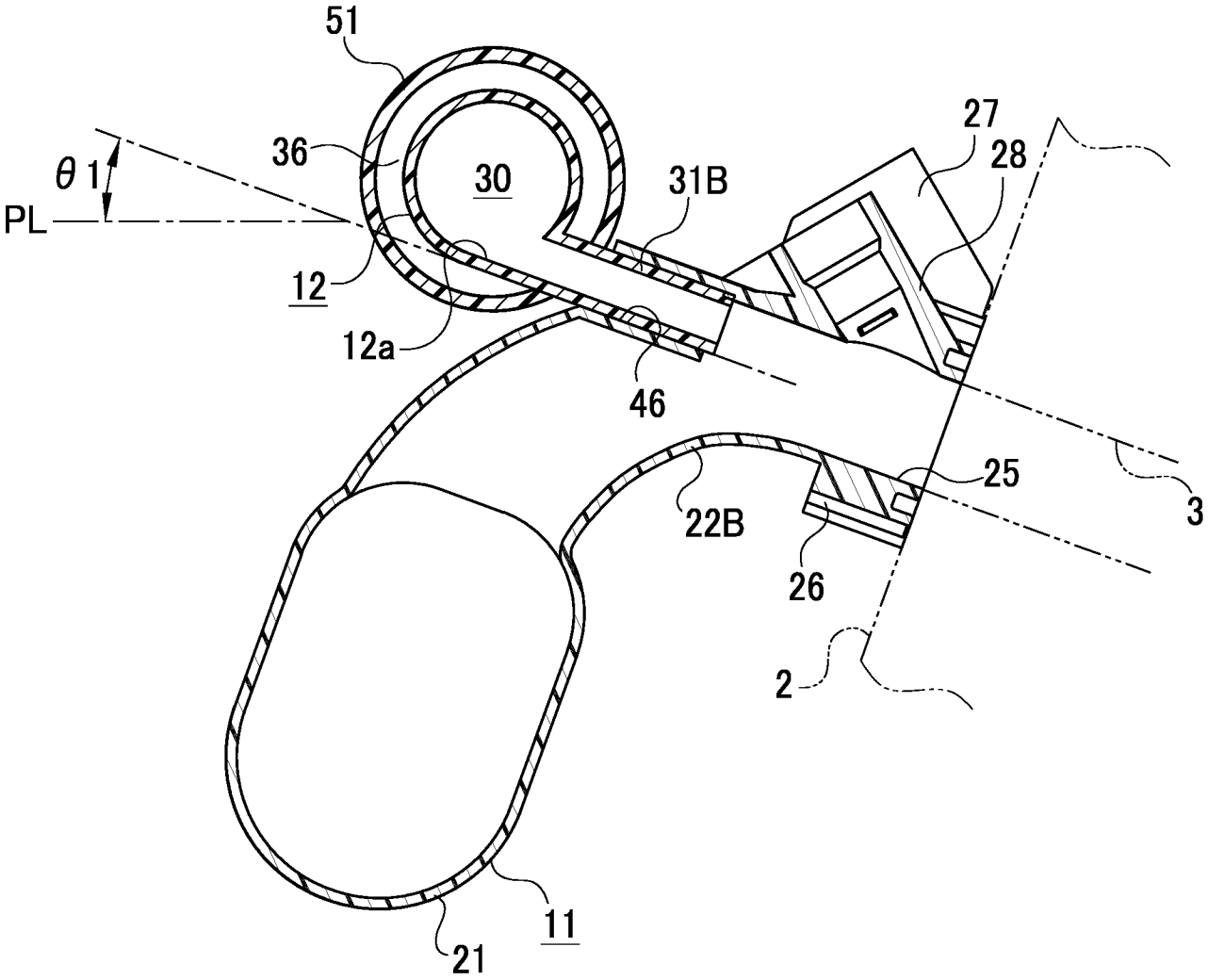
FIG. 15 is a cross-sectional view of an intake apparatus in still another embodiment, corresponding to FIG. 10.

In the foregoing embodiment, the EGR cooler 13 internally containing the hot water passage 36 and the gas passage 37 is provided integrally with the EGR gas distributor 12. As another alternative, as in a similar way to the above example shown in FIG. 14, an additional casing 51 may be provided to surround the EGR gas distributor 12 so that only the hot water passage 36 is provided integrally with the EGR gas distributor 12 as shown in FIG. 15. Furthermore, as shown in FIG. 15, the intake manifold 11 is attached in a position downwardly inclined at a predetermined angle θ1 with respect to a horizontal direction PL onto the engine 2 mounted in a proper position. In this attached state, a bottom wall 12*a* of the EGR gas distributor 12 constituting the gas chamber 30 can be placed to be directed, or inclined, downward relative to the horizontal direction PL and also the bottom wall 12*a* can be configured to be linearly continuous with the inside walls of the gas distribution pipes 31A to 31C. Thus, the bottom wall 12*a* and each gas distribution pipe 31A to 31C can be each arranged to be directed downward relative to the horizontal direction PL. In this case, similarly, a cooling water passage for supplying engine cooling water to an EGR cooler provided separately from the intake manifold 11 is connected to the hot water passage 36, so that the same operations and effects as in the foregoing embodiment can be achieved. In particular, the condensed water generated in the gas chamber 30 is allowed to flow toward the engine 2 without staying in the gas chamber 30. FIG. 15 shows this modified example of the intake apparatus in a cross-sectional view corresponding to FIG. 10.

In the foregoing embodiment, for the purpose of enhancing the heat transfer, the casing 38 integrally constituting the EGR gas distributor 12 and the EGR cooler 13 is entirely made of a resin material containing carbon. As an alternative, only the partition wall that separates the gas chamber of the EGR gas distributor and the hot water passage of the EGR cooler may be made of a resin material containing carbon.

In the foregoing embodiment, the high heat transfer is addressed by the configuration that the partition wall 38*a* and others are made of a resin material with carbon mixed therein. As an alternative, the partition wall may be made of resin with a metal plate embedded therein by insert molding.

In the foregoing embodiment, the EGR gas distributor 12 and the EGR cooler 13 (including the hot water passage 36) are configured as an integral unit so that the EGR cooler 13 is attached to the intake manifold 11 through the brackets 44A and 44B and the connecting rods 47A and 47B. As alternatives, the EGR gas distributor and the EGR cooler (including the hot water passage) may be configured as an integral unit so that the EGR gas distributor is attached to the intake manifold through a connecting means or so that the EGR gas distributor and the EGR cooler are each connected to the intake manifold through corresponding connecting means.

The foregoing embodiment embodies the intake manifold 11 provided with the three branch pipes 22A to 22C. However, the number of branch pipes may be any values without being limited to three.

In the foregoing embodiment, even though the details of the intake manifold 11 are not specified, the intake manifold may be constituted of an integral unit formed of a plurality of separate pieces joined into one.

In the foregoing embodiment, it is simply arranged to allow the engine cooling water that circulates through an engine cooling water passage to circulate as hot water in the hot water passage 36. As an alternative, it also may be arranged to allow the hot water that has passed through an exhaust heat recovery device further placed in an exhaust passage to circulate from the engine cooling water passage into a hot water passage part.

In the foregoing embodiment, the EGR valve 14 is provided in the EGR unit 15; however, this EGR valve may be omitted.

In the foregoing embodiment, EGR gas is adopted as auxiliary gas but PCV gas (blow-by gas) may also be adopted as auxiliary gas.

INDUSTRIAL APPLICABILITY

The present disclosure is applicable as a component of an intake system in various types of engines.

REFERENCE SIGNS LIST

1 Intake apparatus
2 Engine
3 Intake port
11 Intake manifold
12 EGR gas distributor (Gas distributor)
13 EGR cooler (Auxiliary gas cooler)
15 EGR unit
21 Surge tank
22A Branch pipe
22B Branch pipe
22C Branch pipe
25 Intake outlet
29 Gas inlet
30 Gas chamber
31A Gas distribution pipe
31B Gas distribution pipe
31C Gas distribution pipe
36 Hot water passage
37 Gas passage
38 Casing
38*a* Partition wall
38*b* Bottom wall
44A Bracket
44B Bracket
46 Connection hole
47A Connecting rod
47B Connecting rod
48 Pipe section
PL Horizontal direction
θ1 Predetermined angle

What is claimed is:

1. An intake apparatus comprising:

an intake manifold including a surge tank and a plurality of branch pipes each branching off from the surge tank;

a gas distributor provided separately from the intake manifold and configured to distribute auxiliary gas to each of the plurality of branch pipes, the gas distributor including a gas inlet configured to introduce the auxiliary gas, a gas chamber configured to collect the auxiliary gas introduced through the gas inlet, and a plurality of gas distribution pipes each branching off from the gas chamber and each configured to connect to one of the branch pipes;

a plurality of connecting holes each provided in one of the branch pipes and each configured to connect to a corresponding one of the gas distribution pipes; and a hot water passage provided separately from the intake manifold and placed adjacently to the gas chamber to warm an inside wall of the gas chamber at a location of the gas chamber that is downstream from an EGR valve, the hot water passage being configured to flow hot water, wherein the gas chamber and the hot water passage are arranged to traverse the plurality of branch pipes, the gas distribution pipes are each connected to one of the connecting holes, and at least one of the gas distributor and the hot water passage is attached to the intake manifold.

2. The intake apparatus according to claim 1, wherein each of the branch pipes of the intake manifold includes an intake outlet to be connected to an intake port of an engine, and each of the connecting holes of the branch pipes is open near and toward the intake outlet, and when the intake manifold is attached to the engine mounted in a proper position, a part of each of the branch pipes, in which the connecting hole and the intake outlet are provided, is placed to be directed downward relative to a horizontal direction.

3. The intake apparatus according to claim 2, wherein the gas chamber of the gas distributor includes a bottom wall extending in a direction traversing the plurality of branch pipes, and when the intake manifold is attached to the engine mounted in the proper position and the gas distributor is attached to the intake manifold, the bottom wall of the gas chamber is placed to be directed downward relative to the horizontal direction.

4. The intake apparatus according to claim 1, wherein the hot water passage is formed integrally with the gas distributor.

5. The intake apparatus according to claim 1, wherein the hot water is engine cooling water that has been heated as a result of cooling the engine, the hot water passage is provided in an auxiliary gas cooler configured to flow the engine cooling water to cool the auxiliary gas such that the auxiliary gas is cooled at a location upstream from the gas inlet, and the auxiliary gas cooler is formed integrally with the gas distributor.

* * * * *